United States Patent [19]

Perry et al.

[11] Patent Number: 4,487,367

[45] Date of Patent: Dec. 11, 1984

[54] PAINT COLOR CHANGE AND FLOW CONTROL SYSTEM

[75] Inventors: James C. Perry, Almont; Dolph D. Wright, Union Lake, both of Mich.

[73] Assignee: General Motors Corporation, Detroit, Mich.

[21] Appl. No.: 434,279

[22] Filed: Oct. 14, 1982

[51] Int. Cl.[3] ..... F23D 13/28

[52] U.S. Cl. ..... 239/112

[58] Field of Search ..... 239/75, 76, 104, 106, 239/110, 112, 113, 304, 305

[56] References Cited

U.S. PATENT DOCUMENTS

| | | | |
|---|---|---|---|
| 3,009,479 | 11/1961 | Flanders et al. | 137/881 |
| 3,450,092 | 6/1969 | Kock | 239/112 |
| 3,674,205 | 7/1972 | Kock | 239/112 |
| 4,354,624 | 10/1982 | Chowdhury | 239/76 |
| 4,375,865 | 3/1983 | Springer | 239/112 |

FOREIGN PATENT DOCUMENTS 2240577 8/1972 Fed. Rep. of Germany .

*Primary Examiner*—John J. Love
*Assistant Examiner*—Jon M. Rastello
*Attorney, Agent, or Firm*—Warren D. Hill

[57] ABSTRACT

A color change system for supplying paint to a remote spray head uses a paint manifold and suitable valving for supplying paint to either of two supply lines extending to the spray head to enable one supply line to be flushed with cleaning fluid and filled with paint of a new color while the other line is supplying paint of another color. Part of the necessary valving is located at the spray head and that valving includes pressure regulating valves controlled by air pilot pressure to accurately regulate the paint pressure and thus the paint flow rate to paint spray devices.

11 Claims, 3 Drawing Figures

PAINT COLOR CHANGE AND FLOW CONTROL SYSTEM

This invention relates to spray painting systems and more particularly to paint color change systems and paint flow regulation and such systems.

In machine controlled paint systems a limitation on the efficiency of a given machine has been the amount of time required to change from one color to another, as for example when painting automobiles on a production line. To facilitate the color change operation it has been proposed to use two paint supply lines to the spray apparatus, each supply line being fed from a separate paint manifold so that one line can supply paint while the other line is being flushed and refilled with new paint. A disadvantage of that arrangement is the requirement of an extra paint manifold for each spray apparatus. Another source of inefficiency in painting systems arises from the pressure drop in the paint supply lines which is different for paints of different viscosity and which results in variations of paint flow rate. Thus a pressure setting at the paint manifold which is high enough to assure of sufficient paint flow of high viscosity paint will result in an excessive flow of low viscosity paint. While it is known to incorporate separate fluid pressure regulators at a spray apparatus to maintain a constant paint flow these have not been readily incorporated into a fast color change system which also requires valving at or near the spray apparatus.

It is an object of the invention to provide a paint color change system having dual paint supply lines to effect rapid color change without the duplication of paint manifold apparatus. It is another object of the invention to provide a paint color change system having dual supply lines for rapid color change and valved connections with the spray device which also provide accurate pressure control at the spray device.

The invention is carried out by providing a single paint manifold and a valve arrangement for selectively connecting either of two supply lines to the paint manifold and a further valve arrangement for connecting the supply lines to applicator apparatus.

The invention is also carried out by providing a paint color change system having two supply lines selectively connected to paint applicator apparatus and a valve arrangement for simultaneously making the connection and regulating the pressure at the supply apparatus.

Figure 1:
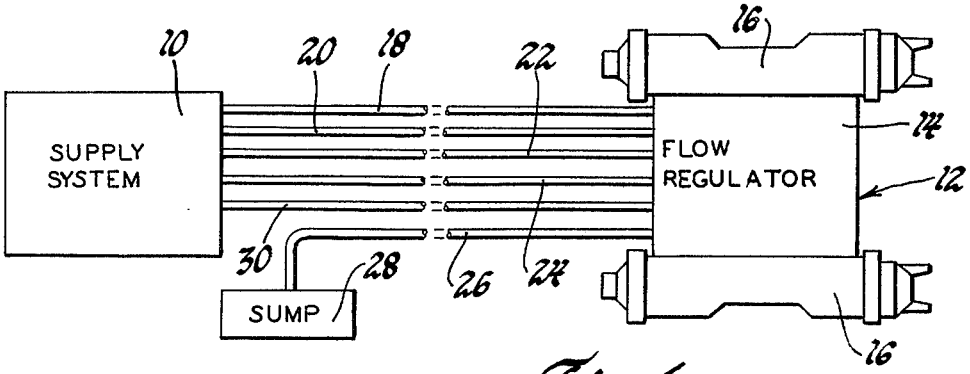

The above and other advantages will be made more apparent from the following specification taken in conjunction with the accompanying drawings wherein like reference numerals refer to like parts and wherein FIG. 1 is a block diagram of a paint color change system and FIGS. 2A and 2B combined diagrammatically illustrate the paint color change system according to the invention.

As shown in FIG. 1 a paint color change system includes a supply system 10 connected to a spray head 12 comprising a flow regulator 14 and spray guns 16 by two paint supply lines 18 and 20, and two air pressure pilot lines 22 and 24. An exhaust line 26 is connected from the flow regulator 14 to a sump 28. An air line 30 carries atomizing air pressure to the spray guns. Each of the lines 18 through 26 and 30 are sufficiently long to allow the spray head 12 to be located remotely from the supply system 10, sometimes many feet apart. As will be seen below the supply system 10 selects the paint or cleaning fluid to be admitted to the lines 18 and 20 while the flow regulator 14 appropriately connects those lines 18 and 20 to the spray guns 16 or the sump 28. To accomplish both paint feed to the spray guns and flushing of one of the supply lines the flow regulator accomplishes that function under the control of the pilot pressure in the lines 22 and 24 and in addition accurately establishes a desired paint pressure at the spray guns as determined by the pilot air pressure.

Figure 2A:
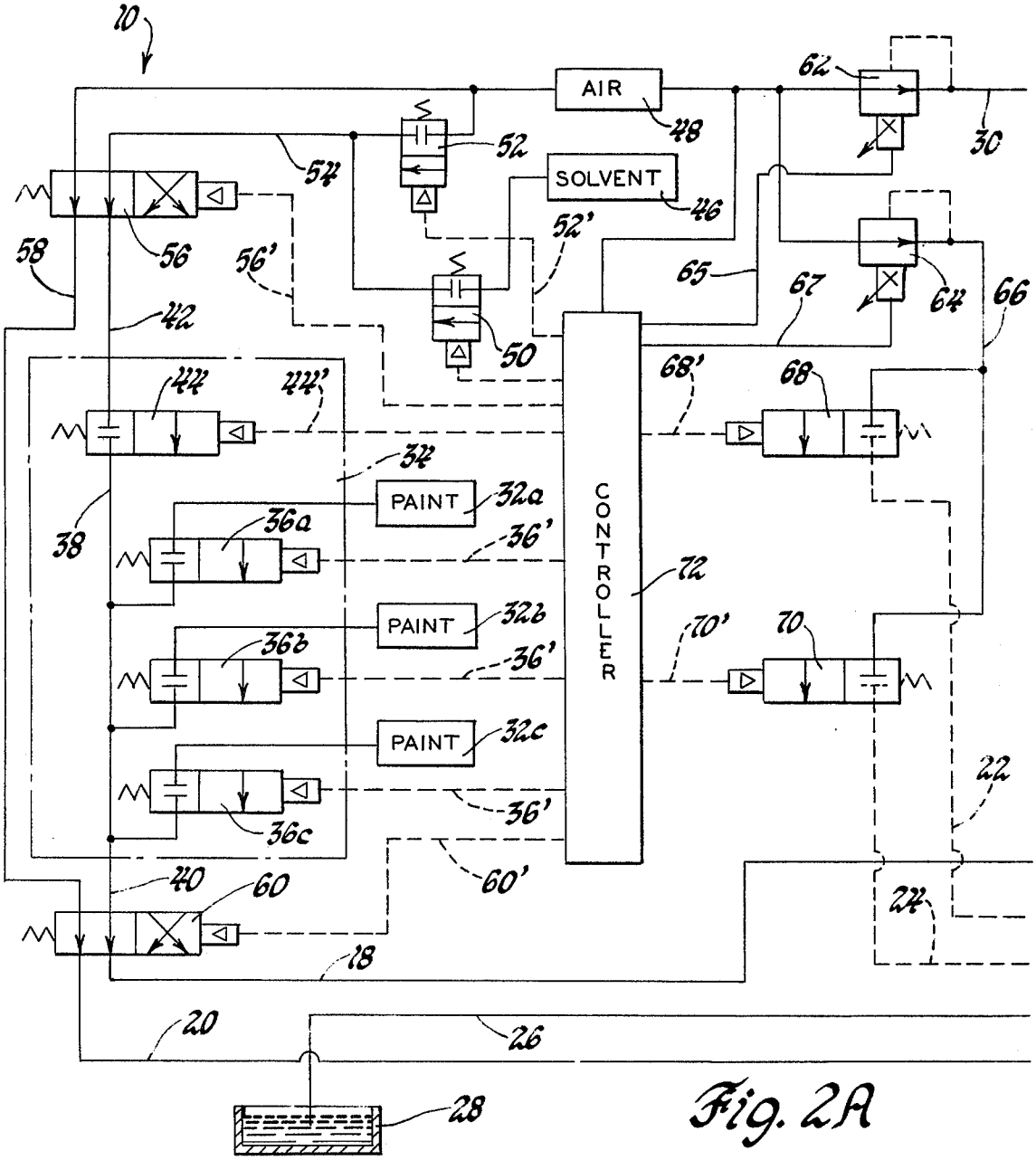
Figure 2B:
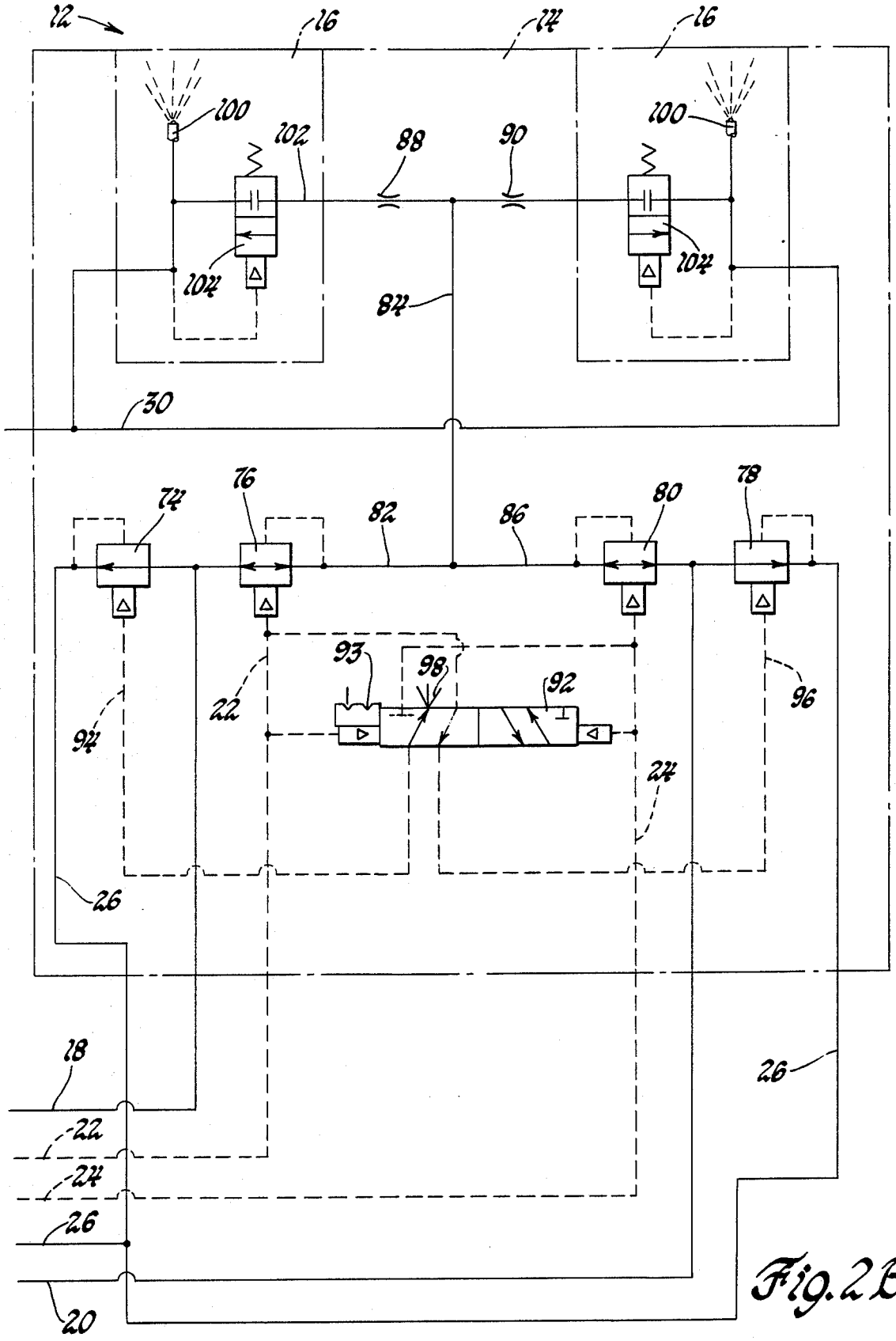

FIG. 2A depicts the supply system 10 and FIG. 2B depicts the sprayhead 12. In FIG. 2A, a plurality of pressurized paint sources 32*a*, 32*b* and 32*c* are connected to respective inlets of a paint manifold 34. The inlets are controlled by normally closed pilot operated two-way valves 36*a*, 36*b* and 36*c* respectively which selectively connect the paint inlets to a common flow passage 38 which leads to a manifold outlet 40. A cleaning fluid inlet 42 is controlled by a normally closed pilot operated two-way valve 44 which selectively connects the inlet 42 to the common flow passage 38. A source 46 of solvent under pressure and an air pressure source 48 are each connected through pilot operated two-way valve 50 and 52 respectively to a line 54 which is connected to an inlet port of a four-way pilot operated valve 56 and the air pressure source 48 is directly connected to another inlet port of the valve 56. The outlet ports of the valve 56 are connected to the inlet 42 of the paint manifold 34 and to a bypass line 58. The outlet 40 of the manifold and the bypass line 58 are each connected to an inlet port of a four-way pilot operated valve 60. The outlet ports of the four-way valve 60 are connected to the supply lines 18 and 20. The air pressure source 48 is connected through a downstream regulated adjustable pressure regulating valve 62 to the atomizing air line 30. The air pressure source 48 is also connected through a regulating valve 64 to establish on line 66 a pressure fixing the desired paint regulation pressure in the sprayhead. The regulating valves 62 and 64 are solenoid operated voltage to pressure transducers responsive to the voltages on lines 65 and 67 to allow the air pressures to be controlled electrically. Pilot operated normally closed two-way valves 68 and 70 selectively connect the line 66 to the pilot lines 22 and 24 respectively.

A controller 72 also connected to the air pressure supply 48 includes an electric controller operating solenoid valves, not shown, for selectively pressurizing pilot lines denoted by the primed numerals 36', 44', 50' et cetera which are operatively connected to respective valves of corresponding numerical order 36, 44, 50 et cetera. The electric controller operates the various solenoids in the proper sequence to obtain the desired paint system function. That is, the controller according to its programming will determine what color paint, if any, or cleaning fluid is supplied to the manifold 34, the selection of the lines 18 and 20 for paint supply or flushing with cleaning fluid, as well as the control of pilot pressure to the lines 22 and 24. The voltage on line 65 is selected by the controller to establish the desired atomizing air pressure in line 30. The voltage on line 67 is also selected by the controller 72 according to the selected paint to thereby provide the correct pressure for each paint to obtain the desired flow rate.

The sprayhead 12 comprises the flow regulator 14 attached to or immediately adjacent to applicator means such as spray guns 16. The flow regulator 14 comprises part of the paint color change system and specifically functions to select which supply line 18 or 20 to connect to the guns 16, to accurately establish a set paint pressure for the desired paint flow rate to the guns 16, to connect the other supply line to the exhaust line for flushing purposes, and to perform some other minor functions to be described below.

The flow regulator 14 has four downstream regulated pilot operated regulating valves 74, 76, 78 and 80. These valves may constitute diaphragm operated poppet valves with pilot air pressure on one side of the diaphragm and downstream fluid pressure acting on the other side of the diaphragm so that the poppet is adjusted to a position effecting pressure balance. If the pilot pressure is set at zero the poppet valve will be closed. The valve 74 is connected between the ends of line 18 and the exhaust line 26 to control flow of fluid from the supply line 18 to exhaust, thus performing the function of a dump valve. The dump valve 74 operates as an on-off valve since the exhaust line 26 normally has a back pressure too low to regulate at the pilot pressure. The valve 76 which is controlled by the pilot line 22 is connected between the end of the supply line 18 and a passage 82 which leads to a common outlet line 84. The valve 78 serves as a dump valve connecting the end of the supply line 20 to the exhaust line 26 and the valve 80 which is operated by the pilot pressure on line 24 connects the end of the supply line 20 to a passage 86 which leads to the common outlet line 84. The line 84 is connected to the spray guns 16 through sharp edged orifices 88 and 90. The orifices preferably are in the flow regulator 14 but they optionally may be physically located in the spray guns 16 without change of function.

The control of pilot pressure to the pressure regulating valves 76 and 78 is via lines 22 and 24 as determined by the operation of the valves 68 and 70 respectively. Supply of pilot pressure to the dump valves 74 and 78 is controlled by a pilot operated two position four-way valve 92 which includes a detent 93 for holding the valve in either position. Input ports of the valve 92 are connected to the pilot lines 22 and 24 while output ports are connected to lines 94 and 96 which are in turn connected to the pilot port of the valves 74 and 78 respectively. In addition a vent 98 is provided in the valve 92. When pilot pressure is applied to line 22 but not line 24 the pressure overcomes the detent and biases the valve to the position shown in the drawings wherein the line 22 is coupled through the valve to the line 96 while the line 94 is connected to the vent 98. Thus in this condition the regulating valve 76 is open to supply paint to the common outlet line 84 and the dump valve 78 is open to connect the supply line 20 to exhaust while the valves 74 and 80 are closed. If pilot pressure is then applied to line 24 while the pressure remains on line 22 the valve 80 will also open, however, the valve 92 will not shift because of the holding action of the detent 93 and the pilot pressures are balanced. This allows paint flow from the supply line 18 through the valve 76, the passages 82 and 86 and the valves 80 and 78 to exhaust. That action is useful briefly at the beginning of paint flow through the valve 76 to flush out residual paint of a previous color from the passage 86 and valve 80. When there is pilot pressure applied to line 24 but not line 22 then the valve 92 is shifted to connect the line 24 to line 94 and to connect the line 96 to vent. Then the valve 80 will be open to supply paint to the common output line 84 and the valve 74 will be open to connect the supply line 18 to the exhaust line 26. Of course if pressure is applied to line 22 then valve 76 will also open to allow flushing of the residual paint from the passage 82.

Because of the pressure regulation of the valves 76 and 80 paint flow therethrough from the respective supply line will be regulated so that the paint pressure in the common line 84 will be the same as the air pressure set by the adjustable air regulating valve 64. This permits accurate paint pressure regulation at the spray guns 16 even though pressure drops through the supply lines 18 and 20 are large as well as variable due to differences in paint viscosity. By maintaining a desired paint pressure at the spray guns the flow rate of the paint through the guns is also well regulated to give good control of the paint coating thickness on the part being sprayed. If the primary metering orifice in the system is a conventional spray gun nozzle then the flow rate will be slightly dependent on the paint viscosity even if a constant paint pressure to the gun is maintained. Substantial freedom from paint viscosity effects is obtained by using a sharp edged orifice 88 or 90 in each paint flow passage to the gun and maintaining a constant paint pressure upstream of the orifice. A sharp edged orifice has a length which is less than five times its diameter. In practice, it has been found that a hole drilled through a plate of diameter nearly equal to the plate thickness and having a square edge at the upstream terminus of the orifice gives good results. Paint flow rate through such an orifice depends primarily on the orifice pressure drop. Thus the controlled pressure determines flow rate. The variations in paint viscosity has substantially no effect on the flow rate for the range of viscosity normally encountered in automotive paints. On the other hand, paint flow through the sharp edged orifice will vary with paint density. Since different paints have different densities the paint pressure is selected for each paint to compensate for density effects. This is accomplished by programming the controller 72 to provide the proper pressure-controlling voltage on line 67.

Each paint spray gun 16 is depicted schematically as a spray nozzle 100 coupled to the line 30 which furnishes atomizing air and coupled to the common paint line 84 through a gun paint passage 102, and a two-way pilot operated valve 104 which is normally closed but which is piloted by the atomizing air on line 30. Thus when atomizing air pressure is applied on line 30 by the operation of the valve 62 the valve 104 in each spray gun is opened to admit paint to the atomizing nozzle.

In operation assume that the pilot line 22 is pressurized so that the valve 76 permits flow from line 18 to the spray guns and the dump valve 78 is open to allow flow from supply line 20 to the sump 28. Further assume that the valve 60 is in the position shown in the drawings and the valve **36*a* is open to supply a first color of paint from the source 32*a* through the common line 38 of the manifold 34 to the supply line 18 and to the spray guns. To remove any residual paint from the supply line 20 the valve 56 is actuated to connect the cleaning fluid passage 54 to the bypass line 58 which in turn is connected through the valve 60 to the line 20, and cleaning fluid is supplied through those lines by alternately opening the valves 50 and 52 to provide pulses of solvent and air which flow through the lines 54, 58 and 20 and through the dump valve 78 and the exhaust line 26 to the sump 28 thereby assuring that the supply line 20 is free of all paint. Then when the part being painted is nearly completed such that there is sufficient paint remaining in the supply line 18 to finish the part the valve 36*a* is closed, the valve 56 is returned to its normal position shown in the drawings to supply air through the bypass line 58 and the valve 60 is shifted to connect the bypass line 58 to the supply line 18 thereby supplying air to the supply line 18 to push out the paint in the supply line to complete the painting of the part. In the meantime the valve 44 is opened to admit cleaning fluid from line 54 to the manifold common line 38 for cleaning out the first color paint from the manifold and exhausting it through the valve 60 and supply line 20 and valve 78 to the exhaust line. Then another manifold inlet valve, say valve 36*b* is opened to connect a second color paint from the source 32*b* to the manifold and to fill the line 20 with the second color paint while the first color paint is still being depleted from the supply line 18. At the completion of painting of the part the atomizing air is removed from line 30 to shut off the spray guns 16. The pilot pressure is removed from line 22 by closing valve 68 and pilot pressure is admitted to line 24 by opening valve 70. Then the regulating valve 76 is closed, the valve 80 is opened, and the valve 92 is shifted causing the dump valve 78 to close and the dump valve 74 to open. Valve 68 is opened momentarily to apply a pulse of pressure on pilot line 22 to open the regulator valve 76 thus allowing the second color of paint to flow from the supply line 20 through the valves 80 and 76 and dump valve 74 to clean out any first color paint in the passage 82 and the valve 76 to avoid any contamination of the second color paint during spraying of another part. The pressure in line 22 is removed to close the valve 76 and the atomizing air is applied on line 30 to cause operation of the guns and flow of the second paint color through the guns to clean out residue of the first color. Then painting commences on the new part and the supply line 18 is then purged with cleaning fluid in the same manner as the previous cleaning of the line 20**.

It will be seen that the system is very efficient due to the short time that the spray guns are out of service for color change operation and that by using only one paint manifold in the system the expense of the system is minimized even though all the advantages of dual supply lines are maintained. Moreover, by incorporating paint pressure regulation as a function of the color change valving immediately adjacent the spray guns accurate paint flow control is attained even though large pressure changes occur in the paint supply lines.

The embodiments of the invention in which an exclusive property or privilege is claimed are defined as follows:

1. A paint color change system including pressure regulation for supplying paint to applicator means comprising:

individual fluid sources for paint and cleaning fluid, first and second supply lines, manifold means for selectively coupling the individual fluid sources to the supply lines, and means for selectively coupling the supply lines to the applicator means including (a) a pair of pilot operated pressure regulating valves each connected between one of the supply lines and the applicator means operable in response to pilot pressure to selectively regulate paint flow to the applicator means or disconnect the said one supply line from the applicator means whereby selective paint flow from the supply lines to the applicator means and paint pressure is controlled by pilot pressure applied to the respective regulating valves, (b) pilot operated dump means for selectively exhausting the supply lines, and (c) pilot pressure control means for selectively directing pilot pressure to each of the valves and the dump means so that when one pressure regulating valve is actuated to connect one supply line to the applicator device the dump means is actuated to exhaust the other supply line, whereby when one supply line is flowing paint to the applicator means the other supply line can be flushed with the cleaning fluid.

2. A paint color change system for supplying paint to applicator means at a regulated pressure comprising:

individual fluid sources for paint and cleaning fluid, first and second supply lines, manifold means for selectively coupling the individual fluid sources to the supply lines, and means for selectively coupling the supply lines to the applicator means including (a) a pair of pilot operated pressure regulating valves each connected between one of the supply lines and the applicator means operable in response to pilot pressure to selectively regulate paint pressure to the applicator means or disconnect the said one supply line from the applicator means whereby selective paint flow from the supply lines to the applicator means and the paint pressure to the applicator means is controlled by pilot pressure applied to the respective regulating valves, (b) pilot operated dump means for selectively exhausting the supply lines, and (c) pilot pressure control means for selectively directing pilot pressure to each of the valves and the dump means so that when one pressure regulating valve is actuated to connect one supply line to the applicator device the dump means is actuated to exhaust the other supply line, whereby when one supply line is flowing paint to the applicator means the other supply line can be flushed with the cleaning fluid.

3. A paint color change system for supplying paint to applicator means at a regulated flow rate comprising:

individual fluid sources for paint and cleaning fluid, first and second supply lines, manifold means for selectively coupling the individual fluid sources to the supply lines, and means for selectively coupling the supply lines to the applicator means including (a) a pair of pilot operated pressure regulating valves each connected to one of the supply lines and connected to the applicator means through a passage, orifice means in the said passage for regulating paint flow rate to the applicator means in response to paint pressure in the passage, the regulating valves being operable in response to pilot pressure to selectively regulate paint pressure to the passage or disconnect the said one supply line from the passage whereby selective paint flow from the supply lines to the applicator means and the paint flow rate to the applicator means is controlled by pilot pressure applied to the respective regulating valves, (b) pilot operated dump means for selectively exhausting the supply lines, and (c) pilot pressure control means for selectively directing pilot pressure to each of the valves and the dump means so that when one pressure regulating valve is actuated to connect one supply line to the applicator device the dump means is actuated to exhaust the other supply line, whereby when one supply line is flowing paint to the applicator means the other supply line can be flushed with the cleaning fluid.

4. A paint color change system for supplying paint to applicator means at a regulated pressure comprising:

individual fluid sources for paint and cleaning fluid, first and second supply lines, an exhaust line, manifold means for selectively coupling the individual fluid sources to the supply lines, and valving means for selectively coupling the supply lines to the applicator means including (a) a pair of pilot operated pressure regulating valves each connected between one of the supply lines and the applicator means operable in response to pilot pressure to selectively regulate paint pressure to the applicator means or disconnect the said one supply line from the applicator means whereby selective paint flow from the supply lines to the applicator means and the paint pressure to the applicator means is controlled by pilot pressure applied to the respective regulating valves, (b) a pair of pilot operated dump valves adjacent the pressure regulating valves each connected between one of the supply lines and the exhaust line, and (c) pilot pressure control means for selectively directing pilot pressure to each of the valves so that when one pressure regulating valve is actuated to connect one supply line to the applicator device a corresponding dump valve is actuated to connect the other supply line to the exhaust line, whereby when one supply line is flowing paint to the applicator means the other supply line can be flushed with the cleaning fluid.

5. A paint color change system for supplying paint to applicator means at a regulated pressure comprising:

individual fluid sources for paint and cleaning fluid, first and second supply lines, an exhaust line, manifold means for selectively coupling the individual fluid sources to the supply lines, and valving means for selectively coupling the supply lines to the applicator means including (a) a pair of pilot operated pressure regulating valves each connected between one of the supply lines and a common line leading to the applicator means operable in response to pilot pressure to selectively regulate paint pressure to the applicator means or disconnect the said one supply line from the applicator means whereby selective paint flow from the supply lines through the common line to the applicator means and the paint pressure to the applicator means is controlled by pilot pressure applied to the respective regulating valves, (b) a pair of pilot operated dump valves adjacent the pressure regulating valves each connected between one of the supply lines and the exhaust line operable in response to pilot pressure to selectively connect the supply lines to the exhaust line, and (c) pilot pressure control means for selectively directing pilot pressure to each of the valves so that in one mode one pressure regulating valve is actuated to connect one supply line through the common line to the applicator device and a corresponding dump valve is actuated to connect the other supply line to the exhaust line and in another mode both pressure regulating valves are actuated to open both valves to the common line and one dump valve is actuated to allow fluid flow from one supply line through both open pressure regulating valve and the actuated dump valve to the exhaust line so that back flushing occurs through the pressure regulating valve nearest the actuated dump valve, whereby in the said one mode when one supply line is flowing paint to the applicator means the other supply line can be flushed with the cleaning fluid and in the said another mode paint residue in the common line can be flushed out.

6. A paint color change system for supplying paint to applicator means at a regulated pressure comprising:

individual fluid sources for paint and cleaning fluid, first and second supply lines, an exhaust line, manifold means for selectively coupling the individual fluid sources to the supply lines, and valving means for selectively coupling the supply lines to the applicator means including (a) a pair of pilot operated pressure regulating valves each connected between one of the supply lines and the applicator means operable in response to pilot pressure to selectively regulate paint pressure to the applicator means or disconnect the said one supply line from the applicator means whereby selective paint flow from the supply lines to the applicator means and the paint pressure to the applicator means is controlled by pilot pressure applied to the respective regulating valves, (b) valve means connected to the supply lines adjacent the pressure regulating valves for selectively connecting one supply line to the exhaust line when a pressure regulating valve is actuated to connect the other supply line to the applicator means, and means independent of the manifold means for coupling the source of cleaning fluid to the said one supply line, whereby when the said other supply line is flowing paint from the manifold to the applicator means the said one supply line can be flushed with the cleaning fluid.

7. A paint color change system for supplying paint to an applicator means at a regulated pressure comprising:

a manifold having an outlet, a plurality of paint inlets connected respectively to sources of paint, a cleaning fluid inlet connectable to a source of cleaning fluid, and an inlet valve at each inlet for controlling flow into the manifold, first and second supply lines connectable to the paint applicator means for supplying paint thereto, a bypass line, an exhaust line, first valve means having inlets connected respectively to the source of cleaning fluid and a source of air pressure, for selectively applying cleaning fluid and air pressure to the cleaning fluid inlet and to the bypass line, second valve means having inlets connected to the manifold outlet and the bypass line and outlets connected to the first and second supply lines and actuable to alternately connect each inlet in turn to either outlet, third valve means for selectively coupling the supply lines to the applicator means including (a) a pair of pilot operated pressure regulating valves each connected between one of the supply lines and the applicator means operable in response to pilot pressure to selectively regulate paint pressure to the applicator means or disconnect the said one supply line from the applicator means whereby selective fluid flow from the supply lines to the applicator means and the fluid pressure to the applicator means is controlled by pilot pressure applied to the respective regulating valves, (b) a pair of pilot operated dump valves adjacent the pressure regulating valves each connected between one of the supply lines and the exhaust line, and (c) pilot pressure control means for selectively directing pilot pressure to each of the dump valves and pressure regulating valves so that when one pressure regulating valve is actuated to connect one supply line to the applicator device a corresponding dump valve is actuated to connect the other supply line to the exhaust line and a valve controller for selectively actuating the said inlet valves and said valve means to effect in one mode paint flow through the manifold and one supply line to the applicator means, and concurrent cleaning fluid flow through the other supply line to the exhaust line for cleaning the other supply line during painting, and to effect in another mode the application of air pressure to the said one supply line for pushing previously supplied paint through that line to the applicator means and concurrent cleaning fluid flow through the manifold and the other supply line to the exhaust means for cleaning the manifold during continuation of painting.

8. A paint color change system for supplying paint to an applicator means comprising:

a manifold having an outlet, a plurality of paint inlets connected respectively to sources of paint, a cleaning fluid inlet connectable to a source of cleaning fluid, and a valve at each inlet for controlling flow into the manifold, first and second supply lines connectable to the paint applicator means for supplying paint thereto, a bypass line, first valve means having inlets connected respectively to the source of cleaning fluid and a source of air pressure for selectively applying cleaning fluid and air pressure to the cleaning fluid inlet and to the bypass line, second valve means having inlets connected to the manifold outlet and the bypass line and outlets connected to the first and second supply lines and actuable to alternately connect each inlet in turn to either outlet and a valve controller for selectively actuating the said valves and valve means to effect in one mode paint flow through the manifold to one supply line, and concurrent cleaning fluid flow to the other supply line for cleaning the other supply line during painting, and to effect in another mode the application of air pressure to the said one supply line for pushing previously supplied paint through that line and concurrent cleaning fluid flow through the manifold for cleaning the manifold during continuation of painting.

9. A paint color change system for supplying paint to an applicator means comprising:

a manifold having an outlet, a plurality of paint inlets connected respectively to sources of paint, a cleaning fluid inlet connectable to a source of cleaning fluid, and a valve at each inlet for controlling flow into the manifold, first and second supply lines connectable to the paint applicator means for supplying paint thereto, a bypass line, first pilot operated four-way valve means having inlets connected respectively to the source of cleaning fluid and a source of air pressure and outlets connected respectively to the said cleaning fluid inlet and the bypass line for selectively applying cleaning fluid and air pressure to the cleaning fluid inlet and to the bypass line, second pilot operated four-way valve means having inlets connected to the manifold outlet and the bypass line and outlets connected to the first and second supply lines and actuable to alternately connect each inlet in turn to either outlet and pilot pressure control means for selectively directing pilot pressure to each of said valves and valve means to effect in one mode paint flow through the manifold to one supply line, and concurrent cleaning fluid flow to the other supply line for cleaning the other supply line during painting, and to effect in a second mode subsequent to the said first mode the application of air pressure to the said one supply line for pushing previously supplied paint through that line and concurrent cleaning fluid flow through the manifold and the said other supply line for cleaning the manifold during continuation of painting.

10. A paint system for supplying paint to applicator means at a regulated pressure comprising:

individual fluid sources for paint and cleaning fluid, first and second supply lines, manifold means for selectively coupling the individual fluid sources to one end of each of the supply lines, and a spray head remote from the manifold means and coupled to the other end of each of the supply lines comprising applicator means directly attached to paint regulator means, the regulator means having means for selectively coupling the supply lines to the applicator means including (a) a pair of pilot operated pressure regulating valves each connected between one of the supply lines and the applicator means operable in response to pilot pressure to selectively regulate paint flow to the applicator means or disconnect the said one supply line from the applicator means whereby selective paint flow from the supply lines to the applicator means and the paint pressure is controlled by pilot pressure applied to the respective regulating valves, (b) pilot operated dump means for selectively exhausting the supply lines, and (c) pilot pressure control means for selectively directing pilot pressure to each of the valves and the dump means so that when one pressure regulating valve is actuated to connect one supply line to the applicator device the dump means is actuated to exhaust the other supply line, whereby when one supply line is flowing paint to the applicator means the other supply line can be flushed with the cleaning fluid.

11. A paint spray system for supplying paint to applicator means at a regulated rate comprising:

individual fluid sources for paint and cleaning fluid, the paint from different sources having different viscosity, first and second supply lines, manifold means for selectively coupling the individual fluid sources to one end of each of the supply lines, and a spray head remote from the manifold means and coupled to the other end of each of the supply lines, the spray head comprising spray means attached to flow regulator means, the flow regulator means having means for providing a regulated paint pressure, and a sharp edged orifice in the spray head subject to the regulated paint pressure to establish a regulated paint flow rate substantially independent of paint viscosity, the flow regulator means including (a) a pair of pilot operated pressure regulating valves each connected between one of the supply lines and the applicator means operable in response to pilot pressure to selectively regulate paint pressure to the orifice or disconnect the said one supply line from the spray means whereby selective paint flow from the supply lines to the spray means and the paint flow rate to the spray means is controlled by pilot pressure applied to the respective regulating valves, (b) pilot operated dump means for selectively exhausting the supply lines, and (c) pilot pressure control means for selectively directing pilot pressure to each of the valves and the dump means so that when one pressure regulating valve is actuated to connect one supply line to the spray means the dump means is actuated to exhaust the other supply line, whereby when one supply line is flowing paint to the spray means the other supply line can be flushed with the cleaning fluid.

* * * * *